US006778866B1

(12) United States Patent
Bettwy

(10) Patent No.: US 6,778,866 B1
(45) Date of Patent: Aug. 17, 2004

(54) METHOD AND APPARATUS FOR LEARNING SPECIFIC BODY MOTION

(76) Inventor: Ted S. Bettwy, 72297 Magnesia Falls Dr., Rancho Mirage, CA (US) 92270

( * ) Notice: Subject to any disclaimer, the term of this patent is extended or adjusted under 35 U.S.C. 154(b) by 0 days.

(21) Appl. No.: 09/526,887

(22) Filed: Mar. 16, 2000

(51) Int. Cl.[7] ..... G05B 19/18

(52) U.S. Cl. ..... 700/56; 700/57; 700/58; 700/62; 700/63; 700/64; 463/36; 473/215; 473/209; 473/409; 434/252; 434/247

(58) Field of Search ..... 700/56, 57, 58, 700/59, 61, 62, 63, 64; 345/156–158, 355, 419, 420, 473, 496, 331, 332; 463/36, 131–151; 473/215, 209, 211–213, 409; 434/252, 247

(56) References Cited

U.S. PATENT DOCUMENTS 5,625,577 A * 4/1997 Kunii et al. ..... 703/2
5,984,796 A * 11/1999 Mah ..... 473/215
6,005,548 A * 12/1999 Latypov et al. ..... 345/156
6,072,467 A * 6/2000 Walker ..... 345/157
6,122,960 A * 9/2000 Hutchings et al. ..... 73/493
6,126,449 A * 10/2000 Burns ..... 434/252
6,305,221 B1 * 10/2001 Hutchings ..... 73/488
6,404,409 B1 * 6/2002 Solomon ..... 345/31

* cited by examiner

*Primary Examiner*—Ramesh Patel
(74) *Attorney, Agent, or Firm*—Birch, Stewart, Kolasch & Birch, LLP

(57) ABSTRACT

A method and apparatus for teaching a person how to perform a specific body motion in a consistent manner is based on electronically measuring one or more parameters of an actual body motion, comparing the one or more measured parameters with corresponding parameters of a target body motion, and providing a sensible feedback to the user based on a degree of correspondence between the one or more measured parameters and the corresponding target parameters. In a particular embodiment, the feedback is audible. More specifically the feedback is a musical tune that has a particular characteristic (such as rhythm) that is particularly suited to a particular body motion (such as a golf swing). The feedback may be in the form of electronically causing the musical tune to go off-key in proportion to a discrepancy between the actual body motion and the target body motion. In another embodiment, the feedback may be in the form of causing the musical signal to vary in perceivable clarity in proportion to a discrepancy between the actual body motion and the target body motion. The use of a stylized musical tune is also helpful because it is easily remembered, thereby aiding a user attempting a certain body motion without using the apparatus of the present invention.

34 Claims, 2 Drawing Sheets

100
ACCELEROMETER
110
uCONTROLLER
114
RF TRANSMITTER
130
103
RF RECEIVER
130
uCONTROLLER
128
FEEDBACK SIGNAL
ANGULAR VELOCITY SENSOR #1
112
BANDPASS FILTER
120
AMPLIFIER
122
ADC
118
uCONTROLLER
114
RF TRANSMITTER
130
116
ANGULAR VELOCITY SENSOR #2
112
BANDPASS FILTER
120
AMPLIFIER
122
ADC
118
uCONTROLLER
114
RF TRANSMITTER
130
116
RF TRANSCEIVER
130
uCONTROLLER
128
MEMORY
124
102

METHOD AND APPARATUS FOR LEARNING SPECIFIC BODY MOTION

FIELD OF THE INVENTION

The present invention relates to a method and apparatus by which a person can learn a given body motion and be able to consistently repeat that same motion.

BACKGROUND OF THE INVENTION

Certain physical activities (especially, but not only, athletic activities) involve performing specific body motions which ideally must be repeated consistently. Some examples of a specific body motion are, without limitation, swinging a golf club, swinging a baseball bat, shooting a basketball, walking, and signing one's name.

Conventional methods for developing a specific body motion are typically "negative" in the sense of being addressed to teaching a person not to do certain "wrong" things in an attempt to arrive at doing the "right" thing or things. Such conventional methods include devices which physically restrain a person from moving outside of a target envelope of motion, as well as teaching methods which concentrate on eliminating the aforementioned "wrong" things, rather than concentrating on doing the "right" things.

In addition, most teaching methods are directed to a person's conscious mind. The results are almost inevitably poor, because the person becomes preoccupied with making a plethora of biomechanical adjustments in body control and timing. As a result, an attempt to recreate a certain body motion suffers because the person tends to overthink.

SUMMARY OF THE PRESENT INVENTION

In contrast to conventional methods, the present invention is directed to teaching a specific body motion with greater attention to the subconscious, rather than conscious, mind. Therefore, a person trying to learn a given body motion is not preoccupied with various aspects of body control and timing, so that repeated and consistent performance of the desired body motion is facilitated.

In general, the present invention compares a person's actual body motion to a target version of the body motion, and provides a sensible feedback to the person that is proportional to a correspondence between the actual body motion and the target body motion.

The feedback may be in any sensible form according to the present invention, but is importantly of a nature that reflects an approach to a target level of performance, rather than reflecting an incorrect technique. Accordingly, the person trying to learn the motion is encouraged to reach a goal, rather than being negatively reinforced. It is particularly desirable to make the feedback audible, but other forms of feedback are contemplated.

According to the present invention, at least one parameter of motion is detected in order to quantify the actual body motion. For example, local acceleration is measured at at least one point on the body, such as, without limitation, one or both shoulders, one or both wrists, one or both knees, the head, left and/or right sides of the hips, and one or both ankles.

Measured parameters of motion may include, without limitation, local acceleration, time duration of motion, angular rate of motion, and spatial extent of motion, using suitable known measuring devices (which are preferably small enough to be comfortably worn on a user's person).

The parameter(s) of motion representing the target body motion (against which the actual body motion is compared) correspond to the motion of, for example, a golf professional in the case of swinging a golf club, a professional baseball player in the case of swinging a baseball club, a basketball player in the case of shooting a basketball, etc. That is, the parameter(s) representing the target body motion are that of a "good" example. Of course, if the present invention is used to simply improve the basic physical skills of, for example, a physically impaired person, the motion of any physically unimpaired person may be emulated to teach, for example, the motion for signing one's name.

An apparatus according to the present invention includes at least one sensor adapted to be placed on a desired part of the body (e.g., the shoulders). A memory stores information corresponding to the target body motion. A microprocessor compares the measured parameter(s) associated with the actual body motion, with corresponding parameter(s) associated with the target body motion. The apparatus also includes a feedback mechanism that operates to provide a sensible feedback that is proportional to a degree of correspondence between the actual body motion and the target body motion. It is preferable, but not required, to provide wireless communication between the at least one sensor, microprocessor, and/or feedback mechanism in order to make the apparatus less cumbersome to the user.

DETAILED DESCRIPTION OF THE PRESENT INVENTION

Figure 1:
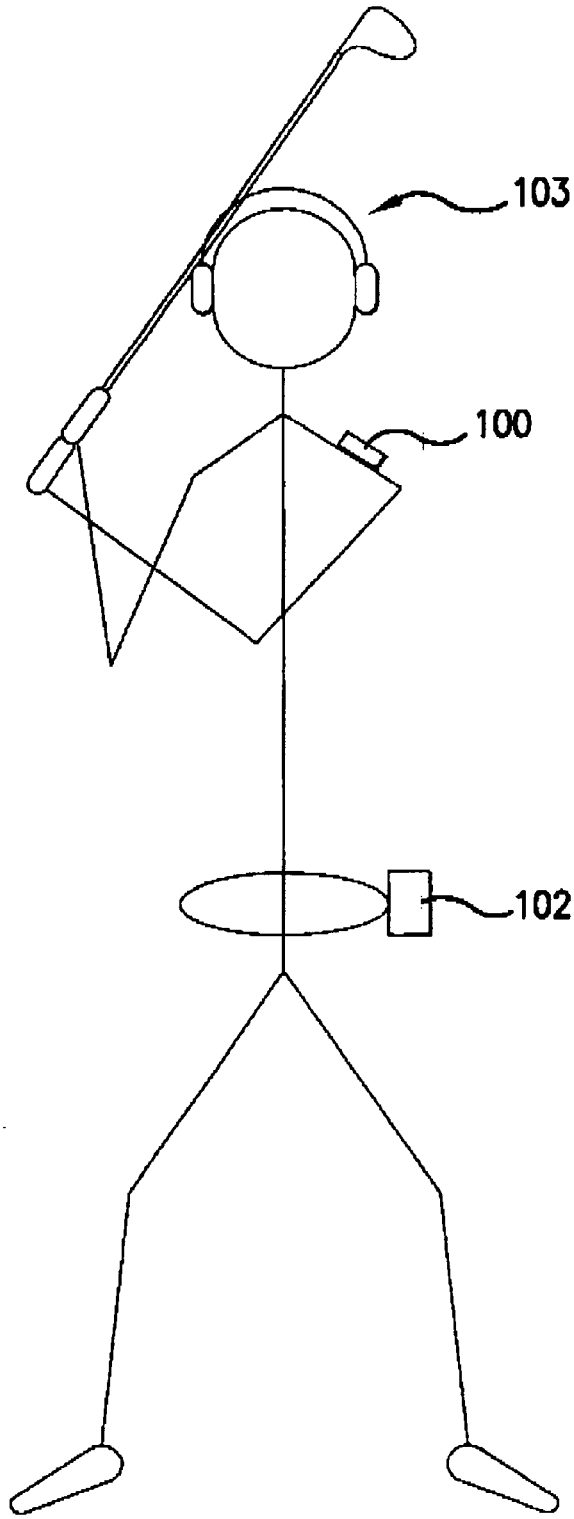
FIG. 1 illustrates an apparatus according to the present invention, as worn by a user.

FIG. 1 illustrates an apparatus according to the present invention, as employed by a user (who, in this instance, is poised to swing a golf club).

In general, the apparatus includes at least one sensor 100, which is adapted to be placed securely on the user's person in a known manner (including, without limitation, a hook and loop fastener, spring clip, tape, or adhesive). In this case, sensor 100 is shown as being placed on the left shoulder. More than one sensor 100 may be employed in accordance with the foregoing, and may be placed, without limitation, on the head, on the other shoulder, at one or both elbows, at one or both wrists, on one or both hands, at left and/or right sides of the hips, on one or both knees, or on one or both ankles.

Each sensor 100 is generally constructed to locally measure a certain parameter of motion. Two typical parameters that are measured are local acceleration and angular velocity. Other measured parameters of motion may include, without limitation, time duration of motion and spatial extent of motion, using suitable known measuring devices (which are preferably small enough to be comfortably worn on a user's person at specific locations on the body).

Except for measuring different parameters, each sensor 100 is generally identical to the extent it includes a sensing mechanism and a microcontroller constructed and arranged to convert a measurement signal from the sensing mechanism into an electronic form.

Examples of sensors 100 in accordance with the present invention include, without limitation, accelerometers commercially available from, for example, Analog Devices, Inc. under Model Nos.

Figure 2:
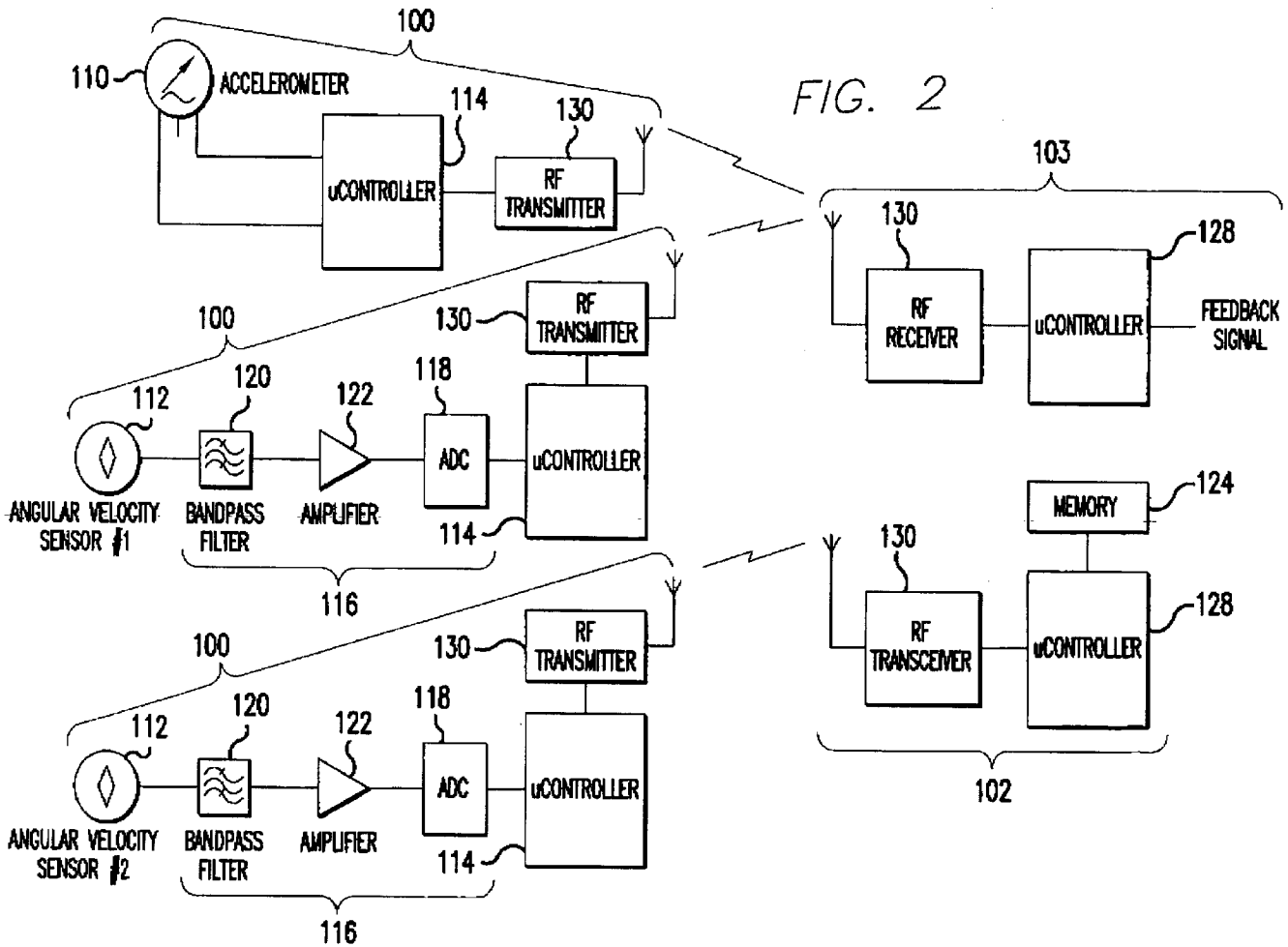
FIG. 2 schematically illustrates the respective elements of the apparatus according to the present invention.

ADXL202 and ADXL210; and gyroscopic angular velocity sensors commercially available from, for example, Murata Mfg. Co., Ltd., Model No. ENC-03J A schematic diagram of the apparatus according to the present invention is illustrated in FIG. 2. As shown in FIG. 2, three sensors 100 are provided: one sensor 100 including a sensing mechanism 110 for sensing acceleration, and two sensors 100 each including a sensing mechanism 112 for sensing angular velocity. Sensing mechanisms 110, 112 are connected to respective microcontrollers 114. In addition, depending on the nature of the sensing mechanism used (e.g., with respect to component quality or digital versus analog signal output), other electronic components, generally indicated by 116, may be used, including an analog/digital converter 118, a bandpass filter 120, and an amplifier 122, in a manner appropriate to particular operational requirements as is known in the art.

The converted signal is then provided to processing unit 102, which may be conveniently worn on a belt, as seen in FIG. 1. In the alternative, processing unit 102 may be worn on a harness or in a vest (not shown) or in any other known fashion, preferably in a manner that does not impede the freedom of motion of the user.

Processing unit 102 includes a conventional memory 124 in which information associated with the target motion is stored, especially parameters of the target motion corresponding with those measured by the use of one or more sensors 100. In addition, processing unit 102 includes a microcontroller 126 for receiving information from the at least one sensor 100 and comparing it (in a known manner) with the corresponding parameter(s) associated with the target body motion.

On the basis of the comparison between the measured parameter of the actual motion and the corresponding parameter of the target motion, the microcontroller 126 determines a degree of correspondence between the actual body motion and the target body motion. In general, this degree of correspondence is considered over a continuous range, but, solely for the purpose of simplifying quantification, may be generally considered in terms of a large discrepancy between the actual body motion and the target body motion, a moderate discrepancy between the actual body motion and the target body motion, and substantially no discrepancy between the actual body motion and the target body motion.

Based on the degree of correspondence between the actual body motion and the target body motion, a feedback mechanism 103 provides a sensible feedback to the user. Feedback mechanism 103 includes, in general, a microcontroller 128 for generating a feedback signal according to the present invention. As seen in FIG. 1, the feedback may be audible, so feedback mechanism 103 may be in the form of an earpiece or headset, for example. However, it is contemplated that the feedback may also be visual (for example, a variety of lights or light patterns) or tactile (for example, a perceivable vibration having a variable frequency) (in accordance with known methods) in accordance with the present invention.

According to a preferred embodiment of the present invention, the feedback is audible, as mentioned above. More particularly, the feedback is a musical tune, the clarity of which (as perceived by the user) increases as the actual body motion approaches the target body motion. By "clarity," as used here, an analogy to tuning a particular frequency on a radio is made, by which a frequency may be, progressively, relatively very fuzzy, relatively less fuzzy, and, finally, substantially clear. In another embodiment according to the present invention, the musical key of the tune may be electronically distorted in proportion to the discrepancy between the actual body motion and the target body motion, such that an improvement in the actual body motion (i.e., as it approaches the target body motion) causes the musical tune to become "in tune."

The use of the musical tune is additionally beneficial because the tune preferably has an auditory characteristic (especially, but not only, rhythm) that has particular correspondence to a given body motion (for example, a golf swing). The use of such a stylized musical tune is also beneficial because, over time, it becomes easy to recall the tune (e.g., while out on a golf course) so as to act as a biomechanical mnemonic device for remembering a proper rhythm of the desired body motion.

It is desirable to have the elements 100, 102, and 103 communicate without physical connection therebetween, in order to avoid affecting the user's freedom of motion. Therefore, sensor 100, processor unit 102, and feedback mechanism 103 are all provided with, for example, RF transceivers or receivers 130 (including suitable antennas and the like) according to known technology in order to send and receive information therebetween. However, any combination of sensor 100, processor unit 102, and feedback mechanism 103 may be also completely physically connected (by wires and the like) or partly physically connected and partly connected by wireless communication methods, in any combination.

In addition, the provision of separate elements 100, 102, and 103 is purely by way of example. It will be readily appreciated the constituent elements may be arranged or combined in a variety of combinations. For example, the memory 124 and microcontroller 126 of processing unit 102 may be incorporated into the feedback mechanism 103 (as embodied by a headset/earpiece as illustrated), so as to eliminate the need for a separate element 102.

A method according to the present invention includes using k sensors to measure a corresponding number of parameters of the actual body motion. Different parameters (e.g., local acceleration versus angular velocity) may be measured.

In real time, the processor of processing unit 102 determines k values of $DPk_n$, which is the difference between a given target parameter and the corresponding actual parameter at time n. Thereafter, the processor multiplies each of $DP1_n \ldots DPk_n$ by a respective weighting factor $w1_n \ldots wk_n$, which yields values of $F1_n \ldots Fk_n$. The weighting factors may, by default, all be 1.0. However, one or more of the weighting factors may be changed in order to emphasize the effect of the corresponding parameter(s) of motion in reaching the target body motion. Likewise, one or more of the weighting factors may be 0.0 in order to obviate the effect of the corresponding parameter(s) of motion in reaching the target body motion.

Thus, in accordance with the disclosure hereinabove, the array $F1_n \ldots Fk_n$ is applied to the musical tune at time n (and a new array $F1_{n+1} \ldots Fk_{n+1}$ is applied at time n+1, etc.). Each non-zero value causes the tune to be played "off-key" in proportion to $$\sum_{1}^{k} Fkn.$$

Accordingly, if all values of $Fk_n$ are zero, the actual body motion is completely in conformance with the target body motion, so the musical tune is "in tune."

Alternatively, each non-zero value of $F1_n \ldots Fk_n$ causes the tune to become less audibly clear (i.e., fuzzy) by a known mechanism, in proportion to $$\sum_{1}^{k} Fkn.$$

Thus, if all values of $Fk_n$ are zero, the musical tune is relatively clearly audible to the user.

The present invention being thusly described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for teaching a person a body motion to permit consistent repetition of the body motion, comprising:

electronically sensing dynamic parameter(s) of the actual body motion;

comparing the sensed dynamic parameter of the actual body motion with a corresponding parameter associated with a target version of the body motion to obtain values of $DP1_n \ldots DPk_n$, the difference between the target parameter of motion and the actual parameter of motion at time n; and providing a sensible feedback to the person, the feedback resembling a target signal based on a degree of correspondence between the actual body motion and the target motion.

2. The method according to claim 1, wherein electronically sensing at least one dynamic parameter of the actual body motion comprises electronically detecting a parameter of motion associated with at least one point on the person's body.

3. The method according to claim 2, wherein the parameter of motion is local acceleration.

4. The method according to claim 2, wherein electronically sensing at least one dynamic parameter of the actual body motion comprises electronically detecting a parameter of motion associated with the shoulders.

5. The method according to claim 4, wherein electronically sensing at least one dynamic parameter of the actual body motion further comprises electronically detecting a parameter of motion associated with one or more of: a wrist, the waist, the head, an elbow, and a knee.

6. The method according to claim 1, wherein the sensible feedback indicates one of: a relatively large discrepancy between the actual body motion and the target body motion, a relatively moderate discrepancy between the actual body motion and the target body motion, and substantially no discrepancy between the actual body motion and the target body motion.

7. The method according to claim 6, wherein the sensible feedback is audible.

8. The method according to claim 7, wherein the audible feedback comprises a range of tones corresponding to a degree of correspondence between the actual body motion and the target body motion.

9. The method according to claim 7, wherein the audible feedback comprises providing an audible signal that becomes more clear to the person as the actual body motion approaches the target body motion.

10. The method according to claim 9, wherein the audible signal is a segment of recorded music.

11. The method according to claim 10, wherein the segment of recorded music has a characteristic parameter related to the target body motion.

12. The method according to claim 11, wherein the characteristic parameter is a rhythm of the recorded music.

13. The method affording to claim 1, further comprising multiplying each value of $DPk_n$ by weighting factors $w1_n \ldots wk_n$ at each of the n time intervals so as to obtain values of $F1_n \ldots Fk_n$, where each value of $wk_n$ is at least 1.0.

14. The method according to claim 13, wherein providing a sensible feedback comprises providing a feedback proportional to $$\sum_{1}^{k} Fkn.$$

15. The method according to claim 14, wherein the feedback is audible.

16. The method according to claim 15, wherein the audible feedback comprises a range of tones corresponding to a degree of correspondence between the actual body motion and the target body motion.

17. The method according to claim 15, wherein the audible feedback comprises providing an audible signal that becomes more clear to the person as the actual body motion approaches the target body motion.

18. The method according to claim 17, wherein the audible signal is a segment of recorded music.

19. The method according to claim 18, wherein the segment of recorded music has a characteristic parameter related to the target body motion.

20. The method according to claim 19, wherein the characteristic parameter is a rhythm of the recorded music.

21. An apparatus for teaching a body motion to permit consistent repetition of the body motion, comprising:

at least one sensor for detecting k dynamic parameter(s) of motion associated with an actual body motion;

a memory for storing information corresponding to a target body motion;

a processor for comparing said information corresponding to the target body motion with said dynamic parameters of motion, and for judging a relative degree of correspondence between the actual body motion and the target body motion to thereby obtain values of $DP_1 \ldots DPk_n$; the difference between the target parameter of motion and the actual parameter of notion at time n; and a feedback mechanism for providing a sensible signal, said sensible signal resembling a target signal based on said relative degree of correspondence between the actual body motion and the target body motion.

22. The apparatus according to claim 21, wherein said at least one sensor is an accelerometer for measuring local acceleration.

23. The apparatus according to claim 22, wherein said at least one sensor is adapted to be placed on a user's body.

24. The apparatus according to claim 21, wherein said at least one sensor is adapted to be placed on a user's body.

25. The apparatus according to claim 21, wherein said memory and said processor are provided in a single unit.

26. The apparatus according to claim 25, wherein said single unit is adapted to be worn on a user's person.

27. The apparatus according to claim 21, wherein a signal from said at least one sensor is provided to said processor using RF transmission.

28. The apparatus according to claim 27, wherein a signal from said processor is provided to said feedback mechanism using RF transmission.

29. The apparatus according to claim 21, wherein a signal from said processor is provided to said feedback mechanism using RF transmission.

30. The apparatus according to claim 21, wherein said feedback mechanism comprises an earpiece and said sensible signal is audible.

31. The apparatus according to claim 30, wherein said sensible signal is musical.

32. The apparatus according to claim 30, wherein said feedback mechanism is constructed and arranged to provide an increasingly clear audible signal in correspondence with a degree of correspondence between the actual body motion and the target body motion.

33. The apparatus according to claim 21, wherein said sensible signal is visual.

34. The apparatus according to claim 21, wherein said sensible signal is tactile.

* * * * *